US005247814A

United States Patent [19]

McDonald

[11] Patent Number: 5,247,814

[45] Date of Patent: Sep. 28, 1993

[54] COMBINATION EYEGLASS HOLDER AND WRIST BRACELET

[76] Inventor: Gordon T. McDonald, 819 Auburn Ave., Chula Vista, Calif. 92013

[21] Appl. No.: 628,609

[22] Filed: Dec. 17, 1990

[51] Int. Cl.[5] ..... A44C 13/00

[52] U.S. Cl. ..... 63/1.1; 63/5.1; 351/157

[58] Field of Search ..... 63/1.1, 3, 5.1, 6; 351/156, 157; 24/3 C

[56] References Cited

U.S. PATENT DOCUMENTS

| | | | |
|---|---|---|---|
| 293,418 | 2/1884 | Church | 63/3 X |
| 448,617 | 3/1891 | Hudson | 63/6 |
| 993,303 | 5/1911 | Kirby | 63/6 |
| 1,689,251 | 10/1928 | Ogush | 63/3 X |
| 2,462,425 | 2/1949 | Pratt et al. | 63/3 |
| 2,704,961 | 3/1955 | Weil | 24/3 C X |
| 2,858,733 | 11/1958 | Lodewick et al. | 24/3 C X |
| 3,450,467 | 6/1969 | Phillips | 351/157 |
| 3,827,790 | 8/1974 | Wenzel | 24/3 C X |
| 4,471,509 | 9/1984 | Marks | 24/3 C |
| 4,696,556 | 9/1987 | Perry, III | 351/157 |
| 4,974,956 | 12/1990 | Gill | 24/3 C X |

FOREIGN PATENT DOCUMENTS

| | | | |
|---|---|---|---|
| 704934 | 3/1941 | Fed. Rep. of Germany | 63/3 |
| 930831 | 7/1955 | Fed. Rep. of Germany | 63/3 |
| 662168 | 4/1929 | France | 63/5.1 |
| 319690 | 1/1957 | France | 63/1.1 |
| 132673 | 4/1929 | Switzerland | 63/3 |
| 16468 | of 1887 | United Kingdom | 63/5.1 |
| 22189 | of 1907 | United Kingdom | 63/6 |
| 20982 | of 1908 | United Kingdom | 63/5.1 |

*Primary Examiner*—Peter M. Cuomo
*Assistant Examiner*—Jerry Redman
*Attorney, Agent, or Firm*—William C. Fuess

[57] ABSTRACT

One end of each of two stretchable and tensionable elastomeric hoses, preferably brightly-colored neoprene surgical hoses, slips over and compressively grasps an associated temple piece of an eyeglass frame. Each hose slips through, and is squeezed by, an axial bore within one leg of a one of two "L" shaped fittings. The fittings are typically made of molded plastic. The remaining end of each hose fits over a cylindrical protuberance, located on the leg of the "L" opposite to the bore, of the other fitting than that fitting through which it passes the bore. Accordingly, in a first, eyeglass holder, configuration each fitting compressively affixes to one end of one hose while it simultaneously slips and slides under frictional force through its bore the length of the other hose. By a variably adjustable amount of overlap between the two hoses an eyeglass holder of variable length and tension is realized. In a second, bracelet, configuration each of the two fittings slides through its bore the length of the same hose. The two ends of this hose are compressively affixed to the protuberances of the two fittings, forming a loop. By a variably adjustable amount of overlap of the single hose between the fittings, a closed loop of variable length and tension suitable to engage a human appendage as in a bracelet is formed.

10 Claims, 1 Drawing Sheet

FIG. 1
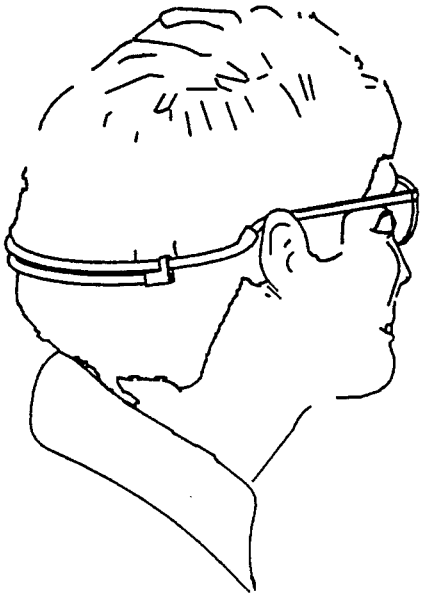
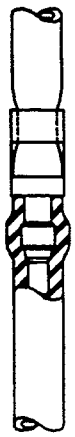
FIG. 2
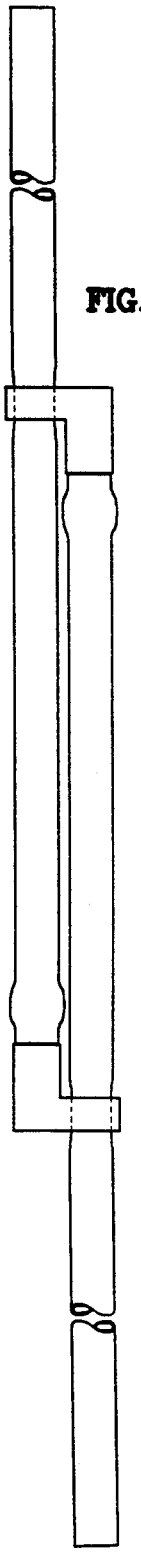
FIG. 3
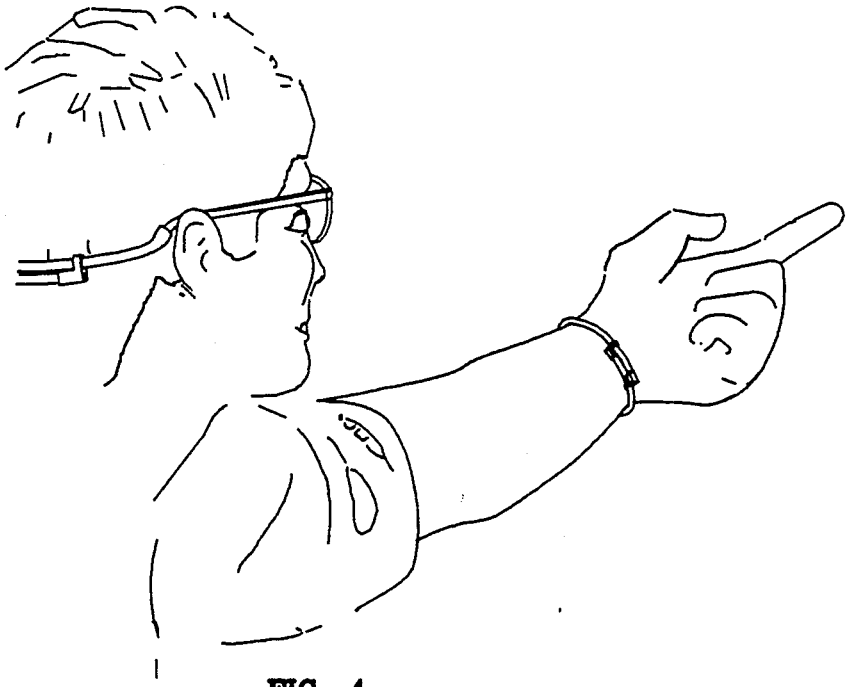
FIG. 4

COMBINATION EYEGLASS HOLDER AND WRIST BRACELET

BACKGROUND OF THE INVENTION

1. Field of the Invention

The present invention generally concerns eyeglass holders, and particularly concerns adjustable waterproof retainers made from tubular material for eyeglasses and sunglasses and the like.

2. Background Information

Eyeglass and sunglass holders, or straps, perform the functions of holding eyeglasses or sunglasses to the head and snugly in place, or, at other times, supporting the eyeglasses or sunglasses to hang loosely around the neck.

An eyeglass or sunglass holder should be economical of manufacture, effective in performance, durable in use, and appealing in design. In particular, an eyeglass holder should be easily manually adjustable in both length and tension during use. Nonetheless to such easy adjustability, the eyeglass holder should hold firmly to the temple pieces, or other parts, of the eyeglasses that are supported upon the user's head. The eyeglass holder should desirably be compact in both use and storage. It should be readily capable of being affixed by the user to various types of eyeglasses and/or sunglasses to perform its holding function, but should be readily detachable when so desired. Finally, an eyeglass holder should be comfortable while in use.

Many previous eyeglass holders, such as those shown in U.S. Pat. No. 3,397,026 and in WIPO international publication no. WO 87/07734 are formed as a loop, preferably up to a foot long, which may be adjusted by a catch or other mechanical means so as to hold eyeglasses tightly to a wearer's head, or, alternatively, to permit the glasses to be held loosely around the wearer's neck. Such a loop at the rear of an eyeglass holder, which may be a fairly large loop for those with small heads or those desiring long eyeglass cords, is both aesthetically and functionally undesirable. It presents an uncomfortable knot, or bulge, beneath the back of the user's head when the user rests upon his/her back. It is subject to being snagged or pulled, and to gather contaminants such as dirt from the environment.

Several types of eyeglass holders that adjust without producing a loop of excess holder material at the rear of the user's head are shown in U.S. Pat. Nos. 182,013; 1,819,738; 3,450,467; and 4,321,804. The first two U.S. Patents show stiff, metal, eyeglass holders in the form of adjustable bows that straddle the head. Nonetheless to the antiquity of these references, the U.S. Pat. No. 1,819,738 for SPECTACLES shows an early attempt to adapt a (metal) bow holder to the temple frames of existing eyeglasses, and to permit the bow to be adjusted transversely of the head by having two members which extend towards, and grasp, each other while overlapping to a variable extent. The two members are connected for sliding relative to each other, but with sufficient frictional binding between them so as to prevent them from slipping out of a set position when in use.

The latter-mentioned U.S. Pat. Nos. 3,450,467 and 4,321,804 show two lengths of chain, cord, or the like each of which terminates in an element having a passageway therethrough. One end of each chain or cord is secured to a respective engaging element after passing through the passageway of the other element. Frictional engagement of each chain or cord in the regions where it passes through the passageway of the element permits a variable overlap, and a variable adjustment, of the eyeglass holder. This adjustment scheme is also recognized in U.S. Pat. No. 4,321,804 to be suitable to produce an ADJUSTABLE NECKLACE OR BRACELET.

This type of adjustment is called "overlapping" within this specification. It is a generally superior type of adjustment, being adjustable over a broad range of lengths in by a compact and reliable adjustment mechanism.

Meanwhile, one modern material for use in forming the loop of an eyeglass holder is a resilient, stretchable, elastomeric tubular hose. Such a hose is typically brightly colored, substantially impervious to wear, breakage, or contamination, and comfortable on use. Alas, there has previously been no effective way to adapt such a length of tube to an overlapping scheme of adjustment. Clips, sleeves, plugs and the like that are suitable for engaging the internal and external surfaces of flexible resilient tubing, including during use of such tubing as a retaining strap for eyeglasses, are known, and are shown, for example, in U.S. Pat. Nos. 4,406,042 and 4,783,164. However, such clips and the like do not support the preferred overlapping adjustment scheme.

Accordingly, although (i) the use of resilient, stretchable, tubular, material within eyeglass holders, and (ii) the adjustment of the length of such tubing by frictional fittings, are both previously known, previous tubular eyeglass holders and retainers made from such tubular material suffer from not having fittings that (i) permit an adjustment of the preferred, overlapping, type to be made, while simultaneously (ii) being effective in use, economical of manufacture and aesthetically pleasing in appearance.

It would be of still further benefit if a functionally-effective, cost-effective, and aesthetically-pleasing combination of a resilient stretchable tubular eyeglass cord and fittings—preferably appropriate to permit an overlapping adjustment—should still further, synergistically, permit that the eyeglass holder should be transformed into some other useful device such as, for example, a bracelet.

SUMMARY OF THE INVENTION

The present invention contemplates an apparatus reconfigurable in its parts consisting of (i) two stretchable and tensionable elastomeric hoses, and (ii) two fittings so as to, at times, serve as an eyeglass holder and so as to, at other times, serve as a bracelet to an appendage of the body. Despite its dual usage, the apparatus is both highly effective, and arguably superior, in each function that it performs relative to the performance of previous eyeglass holders or bracelets.

The apparatus in accordance with the present invention that is user-reconfigurable in its parts to, at times, serve as an eyeglass holder and to, at other times, serve as a bracelet to an appendage of the body includes four parts.

Two stretchable and tensionable elastomeric hoses are of a combined length greater than the distance around the rear of a human's head, and between the temple pieces of eyeglasses worn upon the human's head. The hoses are typically each of a length more than one-half, but less than the totality, of this distance. The hoses will stretch in length, normally to at least one and one-quarter times (×1¼) and more typically to two times (×2) its normal length. Each hose has an internal diameter to its central bore at at least one end, and normally at both ends, that is suitable to slip over and to compressively grasp a temple piece of the eyeglass frames, or any other suitably-sized elongate object. By such compressive grasping the elastomeric hose will temporarily retain the temple piece, or other suitably-sized object. The hoses are preferably made from synthetic rubber, and are more preferably surgical hoses.

The apparatus further includes two fittings. Each fitting has a bore, much shorter than the length of either of the hoses, that is of suitable diameter so as to receive, to squeeze, and to slip a hose so that the hose may slide through the bore under frictional resistance. Each fitting also has a protuberance suitably sized and configured so as to fit within at least one end, and normally within either end, of either hose. The protuberance is compressively grasped and squeezed by the hose so as to be semi-permanently affixed thereto. Each fitting is preferably in the general shape of an "L" with the protuberance being a coaxial cylindrical extension to one leg of the "L" while the bore passes perpendicularly through the remaining leg of the "L". The fittings are preferably made from molded plastic.

In a first, eyeglass holder, configuration of the apparatus each fitting compressively affixes to one end of an associated one hose. The fitting simultaneously slips and slides through its bore the length of the other hose. Meanwhile, the remaining ends of each hose are compressively affixed to the temple pieces of the eyeglass frames. The apparatus so assembled constitutes, in and by its user-adjustable variable amount of overlap between the two hoses, a band of variably adjustable length and tension. When positioned around the back of the human's head and between the human's eyeglass frames such a band—adjustable in length and in tension—serves as an adjustable eyeglass holder.

In a second, bracelet, configuration of the apparatus, each fitting compressively affixes of a respective end of one single hose. The remaining hose is temporarily unused. Each fitting simultaneously slips and slides with frictional resistance through its bore the length of the same hose to which it is affixed. The apparatus so assembled constitutes, by a variably adjustable amount of overlap of the hose, a closed loop of variable length and tension suitable to engage a human appendage as a bracelet.

In its function as an eyeglass holder, the apparatus is easily, and reliably, (i) affixable to the temple frames of glasses, and, thereafter, (ii) adjustable to any desired length or tension. During use, including during the user's resting of his/her head in any position upon any surface, the eyeglass holder is softly resilient and comfortable. It presents no uncomfortable protuberance(s) to either side, or to the rearward, of the head. Nonetheless to being comfortable in use like a fabric cord, the components of the eyeglass holder are made of synthetic rubbers and plastics, and are strong, durable, sanitary and resistent to being soiled. An eyeglass holder, or bracelet, formed from the apparatus is typically brightly colored. It will substantially maintain its new appearance and bright coloration indefinitely.

In its embodiment as a wrist bracelet, the apparatus in accordance with the present invention is likewise both (i) easily adjustable in length and in tension, while being (ii) comfortable to slip on, wear upon, or slip off the hand and wrist. The wrist bracelet embodiment is brightly colored, and stylish. It may readily affix a key, or any object having an aperture which the wrist bracelet may thread. Such an apertured key, or like object, will be held upon the users wrist and arm at any desired spatial location and orientation. This operation of the wrist bracelet, equivalent to the elastic action of an expansion watch bracelet which permits the watch to be positioned on the top, or on the bottom, of the wrist permits the user to affix things to his/her wrist, or to his/her body, in any desired location and/or orientation as is dictated by comfort and taste.

These and other aspects and attributes of the present invention will become increasingly clear upon reference to the following drawings and accompanying specification.

BRIEF DESCRIPTION OF THE DRAWINGS

FIG. 1 shows the reconfigurable apparatus of the present invention in its embodiment as an eyeglass holder in operational use upon the head, and with the glasses, of a human user.

FIG. 2 is a detailed view, partially in cut away, of the removable affixation of one of the two fittings of the apparatus of the present invention to one or two of the elastomeric hoses of the apparatus in accordance with the present invention.

FIG. 3 is a detailed view of the manner by which both fittings of the apparatus of the present invention serve to engage one, or two, elastomeric hose(s) in order to variably adjust the overlap between the end of such hose(s), and thereby the length of an eyeglass holder, or a wrist bracelet.

FIG. 4 is a diagrammatic view of the wrist bracelet embodiment of the apparatus of the present invention in operational use upon the wrist of a human user.

DESCRIPTION OF THE PREFERRED EMBODIMENT

The present invention is embodied in an apparatus reconfigurable in its parts, to, at times, serve as an eyeglass holder and to, at other times, serve as a bracelet to an appendage of the body. The parts of the apparatus, not all of which are invariably used in each embodiment, consist of two stretchable and tensionable elastomeric hoses, and two fittings.

The reconfigurable apparatus 1 in accordance with the present invention is diagrammatically shown in its first embodiment as eyeglass holder 11 in use upon the head of a human user 2 in FIG. 1. The eyeglass holder 11 includes two stretchable and tensionable elastomeric hoses 110, 111 and two fittings 112, 113 (fitting 113 is visible in FIGS. 2 and 3). One end of each of the stretchable and tensionable elastomeric hoses 110, 111 connects to a corresponding one of the temple pieces 31 of eyeglasses 3 worn by user 2.

The regions of a common eyeglass temple piece 31, preceding rearward from a hinged affixation to a front piece 32 of the eyeglass frames 3, are called the (i) butt-strap, (ii) shaft, and (iii) earpiece regions. A bend separates the shaft and earpiece regions. In accordance with the present invention, the elastomeric hoses 110, 111 flexibly enlarge and distend under force both (i) radially around a central bore 113, and (ii) axially along the length of the hoses 110, 111. The ends of the hoses 110, 111 are slipped over at least the earpiece region, and normally also past the bend to the shaft region, of the temple pieces 31 of the eyeglasses 3. The hoses 110,111 thereafter engage, and retain, such temple pieces 31, and thereby the eyeglasses 3, by elastomeric compressive forces. These forces serve to grab and snugly retain, the temple pieces 31 under elastomeric compression forces.

The hoses 110, 111, are preferably made of synthetic rubber, or neoprene, and are more preferably surgical grade hoses. Such hoses 110, 111 will stretch and distend, maintaining elastomeric squeezing and tensioning forces, over a broad dimensional range, and for long time durations. They will accordingly reliably semi-permanently attach to eyeglasses 3, and to temple pieces 31, of diverse sizes and forms. The hoses 110, 111 are typically each nine (9) inches in length by one-quarter (¼) inch outside diameter (O.D.) by one-eight (⅛) inch inside diameter (I.D.). They may particularly be custom-colored latex tubing available from Kent Latex Company of Ohio. Fluorescent colors are particularly suitable, although all colors are available. The hoses 110, 111 are substantially immune to environmental contaminants, including, most particularly, hair oil or sweat.

The remaining end of each of the stretchable and tensionable elastomeric hoses 110, 111 is temporarily affixed to a fitting 112, 113, as is most readily visible in FIGS. 2 and 3. Each of the fittings 112, 113 is substantially in the shape of a "L" (as is mostly clearly visible in FIG. 3) with two substantially perpendicular legs 114, 115 to the "L".

The first leg 114 of the fittings 112, 113 presents an axial bore 116 that is substantially perpendicular through such leg 114, and parallel to the remaining leg 115. This bore 116 is of an axial length that is much, much shorter than either of the elastomeric hoses 110, 111 and that is typically one-quarter (¼) inch. It is of an internal diameter slightly less than the normal, uncompressed, external diameter of either of the elastomeric hoses 110, 111, and is typically of three-sixteenths (3/16) inch internal diameter (I.D.). Accordingly, where an elastomeric hose 110, 111 threads the bore of a fitting, 112, 113, is slightly compressed, providing a frictional resistance to the movement of the fitting along the hose, or, conversely, the movement of the hose through the bore of the fitting.

The bore 116 is preferably a few thousandths of an inch, nominally three (3) to four (4) thousandths of an inch, greater in diameter at its end 1161 than at its end 1162. This difference in diameter is exaggerated in FIGS. 2 and 3 for purposes of clarity. The difference in diameter makes the hoses 110,111 enter and slip through, the bore 116 of fittings 112,113 slightly easier in one, preferred, direction. The fittings 112,113 desirably have a better sliding purchase on the hoses 110,111 in a direction serving to loosen the eyeglass holder 11, or the wrist bracelet 12 (shown in FIG. 4) than in the alternative, tightening, direction of adjustment. The eyeglass holder 11, and the wrist bracelet 12, therefore desirably tighten easier than they loosen.

Meanwhile, the remaining, second, leg 115 of the each of the fittings 112, 113, has and presents a protuberance 117 (most clearly visible in FIG. 2) that is sized and configured so as to fit within either end of either elastomeric hose 110, 111. The protuberance 117 is typically five-sixteenths (5/16) inches in length by three-sixteenths (3/16) inch maximum diameter. When so forcibly plugged, and affixed, to the end of a hose 110, 111, the protuberance 117 is compressively grasped within the interior bore 113 of such hose 110, 111, and thereafter semi-permanently retained. The protuberance 117, which is parallel to the second leg 115 of which it forms the end region, is normally cylindrical with one or more raised regions, or surface features, that serve, when grasped under elastomeric compression force within the bore 113 of an elastomeric hose 110, 111, to securely semi-permanently retain the hose affixed to the protuberance 117, and thereby to the fitting 112, 113.

The force by which the hoses 110,111 are semi-permanently retained to the protuberances 117 of fittings 112,113 is greater than the frictional sliding force, in either direction, of the hoses 110,111 through the bores 116 of the same fittings 112,113. In this manner the eyeglass holder 11, or the wrist bracelet 12, may readily be adjusted in length or in tension at forces desirably less than those required for disassembly.

The fittings 112, 113 are preferably made from molded plastic, and more preferably from polypropylene.

By such configuration, it is obvious that in the first, eyeglass holder 11, embodiment of the apparatus 1 of the present invention, each fitting 112, 113 compressively affixes to one end of a respective hose 111, 112 while it simultaneously slips and slides through its bore the length of the other hose 112, 111. Meanwhile, the remaining ends of each hose 110, 111 are compressively affixed to the temple pieces 31 of the eyeglass frames 3. This construction constitutes, by the user-adjustable variable amount of overlap between the two hoses 110, 111, a connection of variable length, and tension, around the back of the head of the human 2, and between the temple frames 31 of the eyeglasses 3.

In particular, the external size of either hose relative to the size of either fitting's internal bore is such that the hose slides through the bore under a frictional force of a first magnitude. Meanwhile, the internal size of either hose relative to the size of either fitting's protuberance is so that the hose and the fitting will separate in their compressive affixation under a force of a second magnitude that is greater than the first magnitude. By this relative balance of frictional forces, lengthening and tensioning the apparatus in either of its configurations will cause the hose to slide through a fitting's bore before it pulls from the fitting's protuberance. Accordingly, adjustment is desirably obtained at forces that are less than forces that will result in disassembly of the apparatus into its constituent hoses and fittings.

The first embodiment of the apparatus 1 thus serves as an eyeglass holder 11 that is variably adjustable in length and in tension. When worn upon the head of the user 2, it presents no substantial feature, such as particularly a loop, that extends rearward or sideways, and that is subject to adversely affect comfort (particularly in resting of the head against a surface), or that is subject to being snagged or grabbed.

Each of the elastomeric tubes 110, 111, and/or the fittings 112, 113 may be individually, or collectively, brightly colored. Various color combinations, especially in dayglo or fluorescent colors, permit the eyeglass holder 11 to assume a stylish appearance particularly suitable for casual wear, including at the beach and during swimming. Because the apparatus 1, and its eyeglass holder 11 embodiment, are made from durable, and non-porous materials, it may be suitably sterilized. It is thus suitable for use, and reuse, in demanding conditions including combat and surgical operating rooms.

A second embodiment of the apparatus 1 in accordance with the present invention as a wrist bracelet 12 is diagrammatically illustrated in use upon an appendage, namely the wrist 21, of the user 2 in FIG. 4. The wrist bracelet 12 uses only one of the two hoses 110, 111, but both of the fittings 112, 113. Accordingly, the apparatus 1 may be configured either as the eyeglass holder 11, or as the wrist bracelet 12, but not as both simultaneously. (The user 2 shown in FIG. 4 may be considered to be simultaneously in possession and use of two copies of the apparatus 1 in accordance with the present invention.)

In order to disassemble the eyeglass holder 11, and to assemble the wrist bracelet 12, it is necessary to unplug the end of one of the hoses 110, 111 from its compressive affixation to the protuberance 117 of a fitting 112, 113, and to pull such disconnected hose 110, 111 through the bore of the remaining fitting 112, 113. This removed hose 110, 111 is thereafter set aside. The end of the remaining hose that is not affixed to a protuberance 117 of a fitting 112, 113 is disconnected from a temple piece 31 of eyeglasses 3, and wrapped around in a circle so as to pass through the bore 116 of the same fitting 112, 113, to which its first end already connects. After passage through this bore, the end is compressively affixed to the protuberance 117 of the remaining fitting 112, 113. Such an assembly forms a closed loop of variable length in accordance with the adjustable overlap between the end sections of the single hose 110, 111.

In a like manner that the eyeglass holder 11 was variable in length and in tension, so also is the wrist bracelet 12 adjustable in length so as to be conveniently slipped on or off an appendage of the body, such as a wrist 21 or ankle (not shown), and so as to be tensioned as desired upon such appendage when positioned thereon.

Notably in the wrist bracelet 12, the region where the two ends of the single hose 110, 111 overlap is normally of a lesser lineal extent, and is typically only a few inches, than is the lineal extent of the remaining portion of the closed loop. Particularly if one of the end regions of the single hose 110, 111 passes through the aperture of an object, such as a key (not illustrated) before being temporarily removably affixed to the protuberance 117 of the fitting 112, 113, this will serve not only to affix the apertured object to the wrist bracelet 12, but also to position it along the diameter of such wrist bracelet 12 in the overlapping region of hose 110, 111 between fittings 112 and 113. Because the user may rotate the wrist bracelet 12 upon his/her wrist 21, or other appendage, as he/she desires, any object, such as a key, held by such wrist bracelet 12 may be selectively positioned circumferentially around such appendage, and along the lineal extent of such appendage, as is desired by the user 2. Accordingly, the wrist bracelet 2 provides a convenient, and effective, means of positioning a foreign object any desired location along, and circumferentially about, a human limb.

In accordance with the preceding discussion, certain alterations and adaptations of the present invention will suggest themselves to a practitioner of the plastics, and the personal accessories, design arts. For example, the fittings 112, 113 could be constructed of a metal as opposed to plastic. The number of hoses, and supported connections, could be in triplicate, or even higher numbers. The apparatus 1 need not be limited to use as an eyeglass holder or wrist bracelet, but is obviously suitable to encircle, and to hold, diverse objects such as, for example, skis upon a car carrier.

In accordance with these and other aspects and attributes of the present invention, the invention should be conceived broadly, in accordance with the following claims, only, and not solely in accordance with those particular embodiments within which the invention has been taught.

I claim:

1. An apparatus reconfigurable in its parts to at times serve as an eyeglass holder and to at other times serve as a bracelet to an appendage of the body, the apparatus comprising:

two stretchable and tensionable elastomeric hoses, each of a length more than one-half but less than the totality of the distance around the rear of a human's head and between an eyeglass frame worn upon the human's head, and each of a diameter, at either end, that is suitable to slip over and compressibly grasp a temple piece of the eyeglass frame so as to thereafter temporarily retain the eyeglass frame; and two fittings, each having and presenting a bore, shorter than the length of either of the hoses, suitable to receive and to slip a hose so that the hose may slide through the bore, and a protuberance suitably sized and configured so as to fit within either end of either hose, thereafter to be compressively grasped by such hose so as to be semi-permanently affixed thereto;

wherein in a first, eyeglass holder, configuration each fitting compressively affixes to one end of one hose while it simultaneously slips and slides through its bore the length of the other hose, the remaining ends of each hose meanwhile being compressively affixed to the temple pieces of the eyeglass frame, so as to constitute, by a variably adjustable amount of overlap between the two hoses, a connection of variable length and tension around the back of the human's head and between the eyeglass frame, thereby to serve as an adjustable eyeglass holder;

wherein in a second bracelet, configuration each fitting compressively affixes of a respective end of a same hose, the remaining hose being temporarily unused, while it simultaneously slips and slides through its bore the length of the same hose to which it is affixed, so as to constitute, by a variably adjustable amount of overlap of the hose, a closed loop of variable length and tension suitable to engage a human appendage as a bracelet.

2. The apparatus according to claim 1 wherein the external size of either hose relative to the size of either fitting's internal bore is such that the hose slides through the bore under force of a first magnitude; and wherein the internal size of either hose relative to the size of either fitting's protuberance is so that the hose and the fitting will separate in their compressive affixation under force of a second magnitude, greater than the first magnitude;

whereby when adjustably lengthening and tensioning the apparatus in either of its configurations a hose will slide through a fitting's bore before pulling from the fitting's protuberance, thereby desirably permitting adjustment at forces that are less than forces that will result in disassembly.

3. The apparatus according to claim 1 wherein the fitting's protuberance comprises:

an elongate knob having a relatively larger diameter at its head and a relatively smaller diameter at its base.

4. The apparatus according to claim 1 wherein the fitting comprises:

an "L"-shaped member having the bore oriented in one leg of the "L" so as to be substantially parallel to the protuberance which is located on a tip region of the remaining leg of the "L".

5. The apparatus according to claim 4 wherein the "L"-shaped member further comprises:

a blind hole suitably sized and shaped so as to tightly receive the protuberance of another "L"-shaped member, therein to attach to the other "L"-shaped member.

6. The apparatus according to claim 1 wherein each stretchable and tensionable elastomeric hose comprises:

a synthetic rubber tube.

7. An eyeglass holder comprising:

two stretchable and tensionable elastomeric hoses, each of a length more than one-half but less than the totality of the distance around the rear of a human's head, and between temple pieces of eyeglass frames that are worn upon the human's head, and each of a diameter, at either end, that is suitable to slip over and compressively grasp one of the temple pieces of the eyeglass frames so as to thereafter temporarily retain the eyeglass frames; and two fittings, each having and presenting a bore, must shorter than the length of either of the hoses, suitable to receive and to slip one hose so that the hose may thereafter slide through the bore, and a protuberance suitably sized and configured so as to fit within either end of either hose, thereafter to be compressively grasped by such hose so as to be temporarily affixed thereto;

wherein each fitting compressively affixes to one end of one hose while it simultaneously slips and slides through its bore the length of the other hose, the remaining ends of each hose meanwhile being compressively affixed to the temple pieces of the eyeglass frames;

therein constituting, by a variably adjustable amount of overlap between the two hoses, a connection of variable length and tension around the back of the human's head and between the temple pieces of the eyeglass frames, thereby to serve as an adjustable eyeglass holder.

8. An adjustable, disassemblable, and reassemblable bracelet suitable to pass through an aperture of a small object possessing an aperture in order to hold the object to, and in a selectively precise position upon, a human appendage during physical activity by the human, the bracelet that both holds, and selectively positions, a held object comprising:

a stretchable and tensionable elastomeric hose, of a length more than one-half but less than the totality of the distance around the rear of a human's head and between the human's ears, of an internal diameter, at either end, that is suitable to slip over and to compressively grasp a temple piece of an eyeglass frame so as to thereafter temporarily retain the eyeglass frame, and of an external diameter suitable to pass through the aperture of a small object possessing an aperture; and two "L"-shaped fittings, each having and presenting in one leg of the "L", a bore, much shorter than the length of the hose, that is suitable to receive and to slip the hose so that it may slide through the bore, and at a tip region of the remaining leg of the "L", a protuberance that is suitably sized and configured so as to fit within either end of the hose, thereafter to be compressively grasped by the hose so as to be semi-permanently affixed thereto;

each fitting compressively affixing to one end of the hose while it simultaneously slips and slides through its bore the length of the same hose;

therein constituting, by a variably adjustable amount of overlap the hose, a closed loop of variable length and tension that is suitable to engage, at an adjustable distension and compression, a human appendage as an elastic bracelet;

wherein either end of the hose may be temporarily detached from its compressive affixation to the protuberance of a fitting, may be passed through the aperture of the object, and may be forcibly reattached to the protuberance, thereby and thereafter holding the object to be both captive upon the closed loop, and positioned thereupon in a region of overlap;

wherein when the closed loop is adjusted so as to elastically compressively encircle a human appendage, remaining stable thereon, while the object is positioned upon the closed loop, then the object is not only held to the human appendage, but is selectively positioned relative thereto.

9. The bracelet according to claim 8 wherein both the hose and the two fittings are of material unaffected by water, thus making the bracelet suitable for wearing during swimming.

10. An apparatus reconfigurable in its parts to at times serve as an eyeglass holder and to at other times serve as a bracelet to an appendage of the body, the apparatus comprising:

two stretchable and tensionable and compressible elastomeric holes, of a combined length sufficient when positioned end-to-end to span a distance around the rear of a human's head and between eyeglass frames worn upon the human's head, and each of a diameter, at either end, that is suitable to slip over and compressively grasp a temple piece of the eyeglass frames so as to thereafter temporarily retain the eyeglass frames; and two fittings, each having and presenting a bore, much shorter than the length of either of the hoses, suitable to receive and to slip a hose so that the hose may slide through the bore, and a protuberance forcibly manually manipulatable so as to compressively fit within either end of either hose, thereafter to be temporarily compressively affixed thereto;

wherein in a first, eyeglass holder, configuration each fitting compressively affixes to one end of one hose while it simultaneously slips and slides through its bore the length of the other hose, the remaining ends of each hose meanwhile being compressively affixed over the temple pieces of the eyeglass frames, so as to constitute, by a variably adjustable amount of overlap between the two hoses, a connection of variable length and tension around the rear of the human's head and between the eyeglass frames, thereby to serve as an adjustable eyeglass holder;

wherein in a second, bracelet, configuration each fitting compressively affixes of a respective end of a same hose, the remaining hose being temporarily unused, while it simultaneously slips and slides through its bore the length of the same hose to which it is affixed, so as to constitute, by a variably adjustable amount of overlap of the hose, a closed loop of variable length and tension suitable to engage a human appendage as a bracelet.

* * * * *